US008601913B2

(12) United States Patent
Armes

(10) Patent No.: US 8,601,913 B2
(45) Date of Patent: Dec. 10, 2013

(54) PLUMBING TOOL

(76) Inventor: Daniel Armes, Lancing, TN (US)

( * ) Notice: Subject to any disclaimer, the term of this patent is extended or adjusted under 35 U.S.C. 154(b) by 0 days.

(21) Appl. No.: 13/428,273

(22) Filed: Mar. 23, 2012

(65) Prior Publication Data

US 2012/0180606 A1 Jul. 19, 2012

(51) Int. Cl.
*B25B 23/16* (2006.01)

(52) U.S. Cl.
USPC ..... 81/177.2; 81/98

(58) Field of Classification Search
USPC ..... 81/177.1, 177.2, 177.5–177.7, 180.1, 81/184
See application file for complete search history.

(56) References Cited

U.S. PATENT DOCUMENTS

| | | | | |
|---|---|---|---|---|
| 2,305,143 | A | 12/1942 | Curtis | |
| 2,491,623 | A * | 12/1949 | Sesak | 81/99 |
| 2,819,637 | A * | 1/1958 | St Pierre | 81/98 |
| 4,334,443 | A | 6/1982 | Pearson | |
| 4,485,702 | A * | 12/1984 | Swan et al. | 81/98 |
| 4,573,378 | A | 3/1986 | McDonald | |
| D306,200 | S | 2/1990 | Bednar | |
| 5,003,821 | A | 4/1991 | Rivero-Olmedo | |
| D442,051 | S | 5/2001 | Rines | |
| 6,776,068 | B2 | 8/2004 | Reuschel et al. | |
| 7,311,020 | B2 | 12/2007 | George | |
| 2006/0207393 | A1 * | 9/2006 | Stupar | 81/177.75 |

FOREIGN PATENT DOCUMENTS

| | | |
|---|---|---|
| CN | 201034676 | 3/2008 |
| CN | 201307028 | 9/2009 |
| DE | 19748111 | 8/1998 |
| DE | 29911805 | 10/1999 |
| DE | 20218144 | 2/2003 |
| JP | 05209425 | 8/1993 |
| JP | 2007277989 | 10/2007 |
| JP | 2008274697 | 11/2008 |
| JP | 2008298545 | 12/2008 |
| JP | 2010271105 | 12/2010 |

* cited by examiner

*Primary Examiner* — Monica Carter
*Assistant Examiner* — Melanie Alexander
(74) *Attorney, Agent, or Firm* — Robinson IP Law, PLLC

(57) ABSTRACT

A plumbing tool for manipulating a piece of plumbing hardware configured for connection to a fluid meter yoke. A method for manipulating a piece of plumbing hardware configured for connection to a fluid meter yoke.

5 Claims, 12 Drawing Sheets

PLUMBING TOOL

FIELD

This disclosure relates to the field of manual wrench tools. More particularly, this disclosure relates to manual wrench tools for manipulating a piece of plumbing hardware in a confined or difficult to reach space.

BACKGROUND

Wrench technology has somewhat advanced over the past couple of decades, but one thing that has not changed significantly is the ability of a wrench to access a piece of plumbing hardware in difficult to reach places. For example, fluid meter yokes are commonly located in subterranean boxes or other difficult to reach locations. In addition to being difficult to access, a piece of plumbing hardware generally require the application of large amounts of force to install or remove as the associated plumbing hardware must be installed tight enough to substantially prevent leaks.

In a typical method of manipulating a piece of plumbing hardware in a difficult to reach location, such as, for example, a water meter valve, two or more persons are required to both manipulate the valve with a wrench and to hold the water meter in place during manipulation. Further, these existing methods frequently require one of the persons manipulating the valve to lie down or kneel so that the wrench may be placed on the desired valve. Thus, manipulating a water meter valve and other pieces of plumbing hardware configured for connection to a fluid meter yoke may be physically strenuous and difficult, if not impossible, for one person to perform.

What is needed, therefore, is a tool for manipulating a valve or other plumbing hardware associated with a fluid meter yoke wherein the fluid meter yoke is located in a difficult to reach location that allows an individual to manipulate the valve or other hardware and reduces the physical strain required to manipulate the valve or other plumbing hardware.

SUMMARY

The above and other needs are met by a tool configured for manipulating a piece of plumbing hardware configured for connection to a fluid meter yoke, the tool comprising a wrench member including a wrench head and an attachment portion; an elongate arm member including a proximal end and a distal end wherein the distal end of the arm member is connected to the attachment portion of the wrench member, the arm member configured to optionally extend substantially orthogonal to the wrench member; a handle member connected to the arm member, the handle member configured to extend at an angle $\alpha$ relative to the lengthwise orientation of the arm member; a first appendage adjacent the distal end of the handle member extending at an angle $\tau$ relative to the lengthwise orientation of the handle member; and a second appendage proximate the first appendage, the second appendage extending at an angle $\sigma$ relative to the lengthwise orientation of the handle member, forming a gap between the first appendage and the second appendage for partially receiving an elongate shaft of a separate object wherein the separate object is free to rotate along its length axis while the tool optionally remains unmoved.

The attachment portion of the wrench member may include, for example, a first hinge portion and the arm member includes a second hinge portion adjacent the proximal end of the arm member that is engageable with the first hinge portion of the wrench member to form a hinge providing a hinge connection between the wrench member and the arm member.

Additionally or alternatively, the tool may further comprise a contact portion adjacent the distal end of the handle member extending substantially orthogonal to the lengthwise orientation of the arm member for partially contacting an elongate shaft of a separate object wherein the separate object is free to rotate along its length axis while the tool optionally remains unmoved.

As examples, the wrench head member may comprise a wrench selected from the group consisting of a pipe wrench, pliers, an adjustable wrench and a fixed-width wrench.

In another aspect, a tool is provided for manipulating a piece of plumbing hardware configured for connection to a fluid meter yoke, the tool comprising a wrench member including a wrench head and an attachment portion, the attachment portion including a first hinge portion; an elongate arm member including a proximal end and a distal end, wherein a second hinge portion is located adjacent the distal end of the arm member and is engageable with the first hinge portion to form a hinge such that the first arm member is configured to optionally extend substantially orthogonal to the wrench member; an elongate handle member including a proximal end and a distal end, wherein the distal end of the handle member is removably connected to the proximal end of the first elongate arm member, the handle member configured to extend at an angle $\alpha$ relative to the arm member; a securing structure to secure the connection between the arm member and the handle member; a first appendage adjacent the distal end of the handle member extending at an angle $\sigma$ relative to the lengthwise orientation of the handle member; and a second appendage proximate the first appendage, the second appendage extending at an angle $\alpha$ relative to the lengthwise orientation of the handle member, forming a gap between the first appendage and the second appendage for partially contacting an elongate shaft of a separate object wherein the separate object is free to rotate along its length axis while the tool optionally remains unmoved.

Optionally, the tool may further comprise a first length portion of the arm member starting from the proximal end of the arm member and a first length portion of the handle member starting at the proximal end of the handle member wherein the first length portion of the arm member is slidably engageable along the first length portion of the handle member.

As examples, the wrench head may comprise a wrench selected from the group consisting of a pipe wrench, pliers, an adjustable wrench and a fixed-width wrench.

Preferably, the tool further comprises a grip portion disposed around the proximal end of the handle member.

Additionally or alternatively, the tool may further comprise a second length portion of the handle member starting at the distal end of the handle member and extending orthogonal to the first length portion of the handle member, first length portion of the arm member is slidably engageable with the second length portion of the handle member.

As examples, the arm member may comprise a cross-sectional shape selected from the group consisting of circular, ovular, polygonal, and combinations thereof; and wherein the handle member comprises a cross-sectional shape selected from the group consisting of circular, ovular, polygonal, and combinations thereof.

Optionally, the second length portion of the handle member may further comprise a tube proximate the distal end of the handle member wherein the tube includes an elongate aperture therethrough wherein the cross-sectional shape of the elongate aperture is substantially the same as the cross-sectional shape of the majority of the length of the elongate arm member, wherein the handle member can be connected to the arm member via a slidable connection wherein the tube is slidable along the majority of the length of the arm member.

Additionally or alternatively, the first length portion of the arm member may further comprise a plurality of alternate bores therethrough crosswise wherein the first bore and each member of the plurality of alternate bores can be substantially aligned wherein a removable pin can be inserted therethrough to hold the arm member in place relative to the handle member.

Additionally or alternatively, the second length portion of the handle member includes a first bore therethrough crosswise and the first length portion of the arm member includes a second bore therethrough crosswise, wherein the first bore and the second bore are substantially aligned wherein the removable pin can be extended therethrough to hold the arm member in place relative to the handle member In another aspect, embodiments of the disclosure provide for a method for manipulating a piece of plumbing hardware configured for connection to a fluid meter yoke, the method comprising the steps of: (a) engaging a wrench tool to a first section of a fluid meter yoke configured for connection to a piece of plumbing hardware, wherein the wrench tool further comprises (i) a wrench member including a wrench head and an attachment portion, (ii) an elongate arm member including a proximal end and a distal end wherein the distal end of the arm member is connected to the attachment portion of the wrench member, the arm member configured to be extendable in a manner substantially orthogonal to the wrench member, (iii) an elongate handle member including a proximal end and a distal end, wherein the distal end of the handle member is connected to the proximal end of the first elongate arm member, the handle member configured to be extendable in a manner substantially orthogonal to the arm member, (iv) a first appendage proximate the distal end of the handle member extending at an angle $\tau$ relative to the lengthwise orientation of the handle member; and (v) a second appendage proximate the first appendage, the second appendage extending at an angle $\sigma$ relative to the lengthwise orientation of the handle member, forming a space between the first appendage and the second appendage for partially receiving an elongate shaft of a separate object; (b) engaging a valve wrench to a first section of a valve to manipulate the valve relative to the fluid meter yoke; (c) situating the shaft of the valve wrench at least partially between the first appendage and the second appendage of the wrench tool; and (d) rotating the shaft of the valve wrench along its lengthwise axis to manipulate the valve relative to the fluid meter yoke while holding the fluid meter yoke steady using the wrench tool.

As examples, the valve preferably comprises a valve selected from the group consisting of a check valve and an angle valve.

Optionally, the distal end of the handle member is removably connected to the proximal end of the first elongate arm member.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Figure 1:
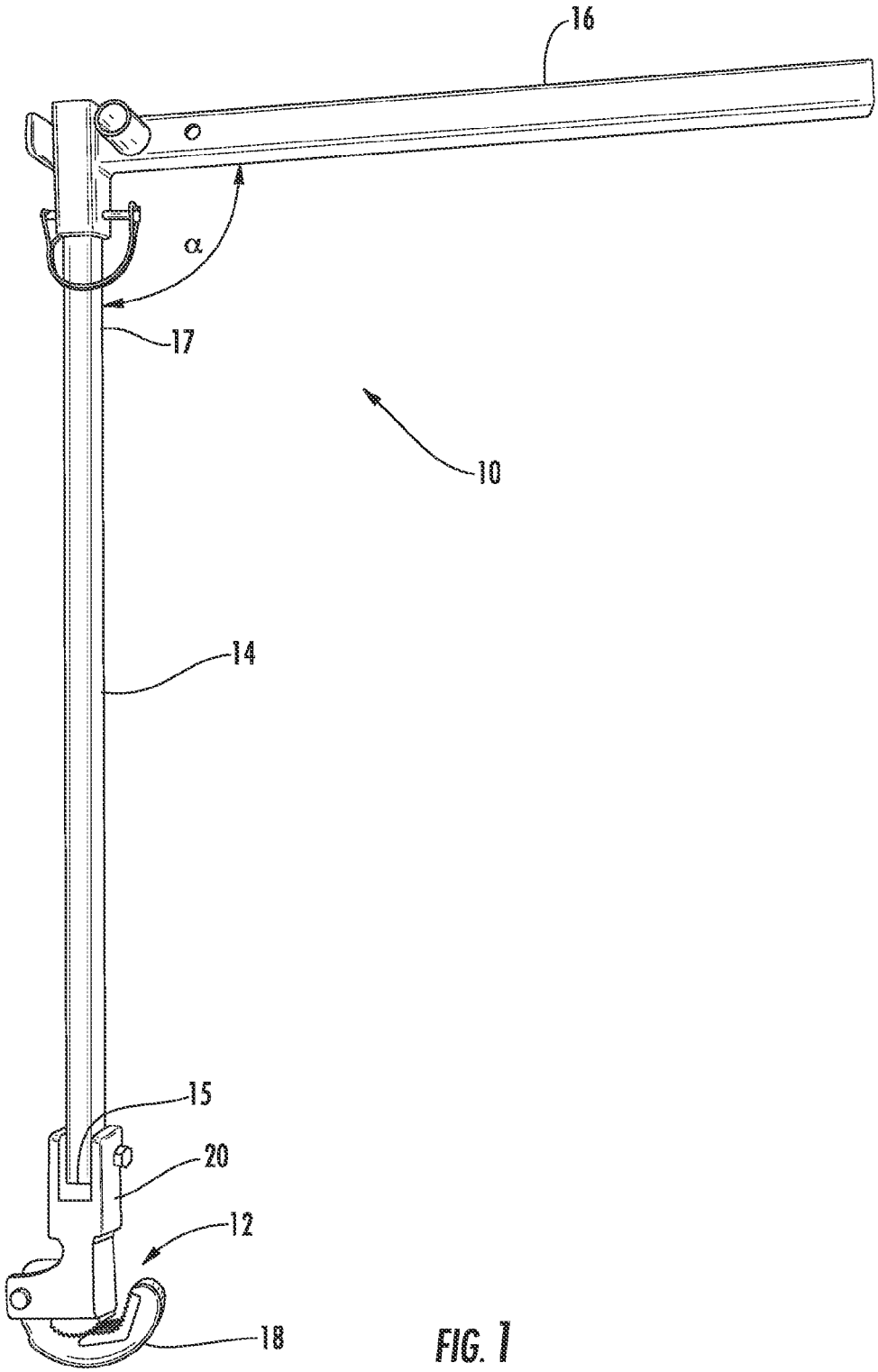
FIG. 1 shows a side view of an embodiment of a wrench tool in a first configuration as described herein.

FIG. 1 depicts an embodiment of a wrench tool 10 including a wrench member 12, an elongate arm member 14, and a handle member 16. The wrench member 12 is preferably connected to a distal end 15 of the arm member 14 such that the arm member 14 preferably can extend substantially orthogonal to the lengthwise orientation of the wrench member 12. The handle member 16 is preferably connected to the arm member 14 with the handle member 16 extending at an angle $\alpha$ from the arm member 14, the angle $\alpha$ preferably ranging from about 30° to about 150° and more preferably from about 80° to about 100°.

Figure 2:
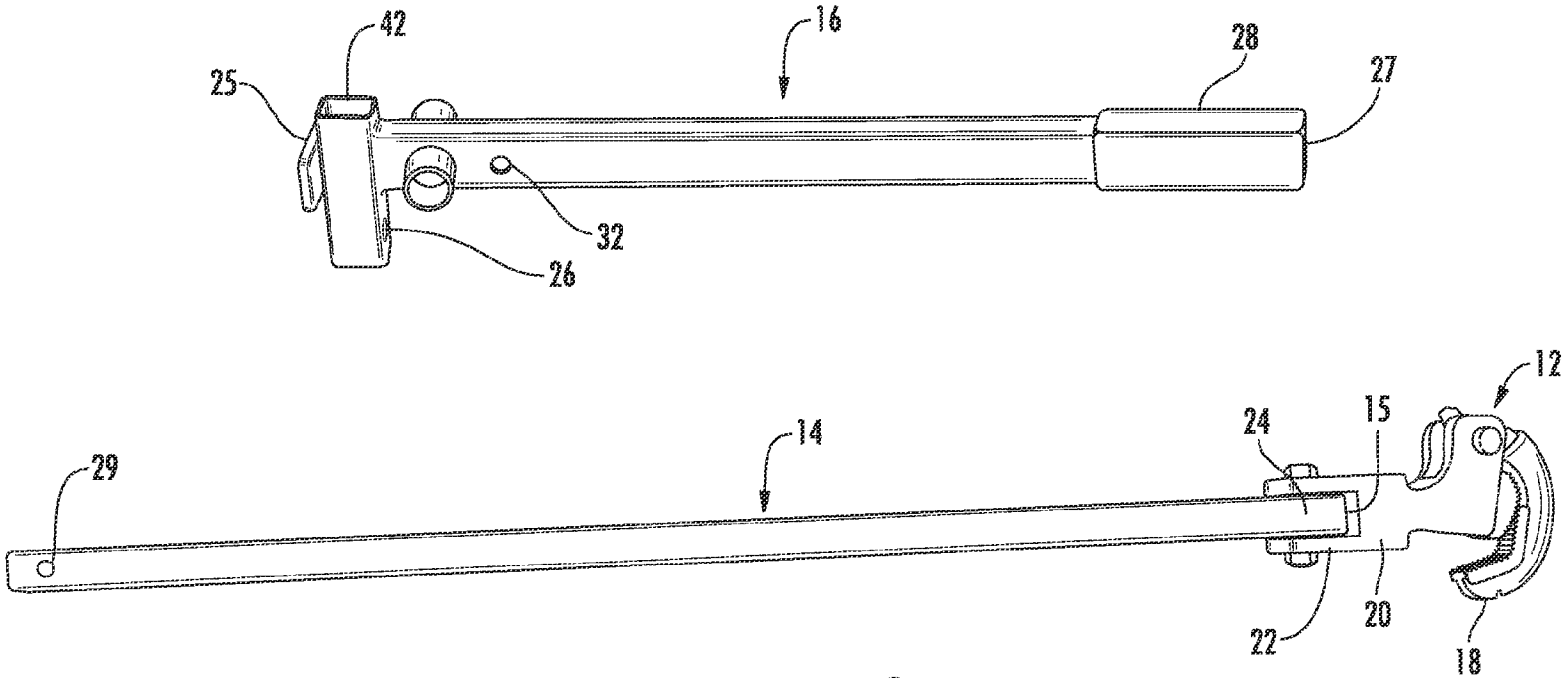
FIG. 2 shows a partially disengaged side view of the wrench tool of FIG. 1 as described herein.

FIG. 2 shows a side view of the wrench tool 10 in a disassembled format. The wrench member 12 includes a wrench head 18 and an attachment portion 20. The wrench head 18 preferably includes a pipe wrench, pliers, an adjustable wrench or a fixed-width wrench. The wrench member 12 also preferably includes a first hinge portion 22 for hingedly connecting the wrench member 12 to the distal end 15 of the elongate arm member 14.

Figure 12:
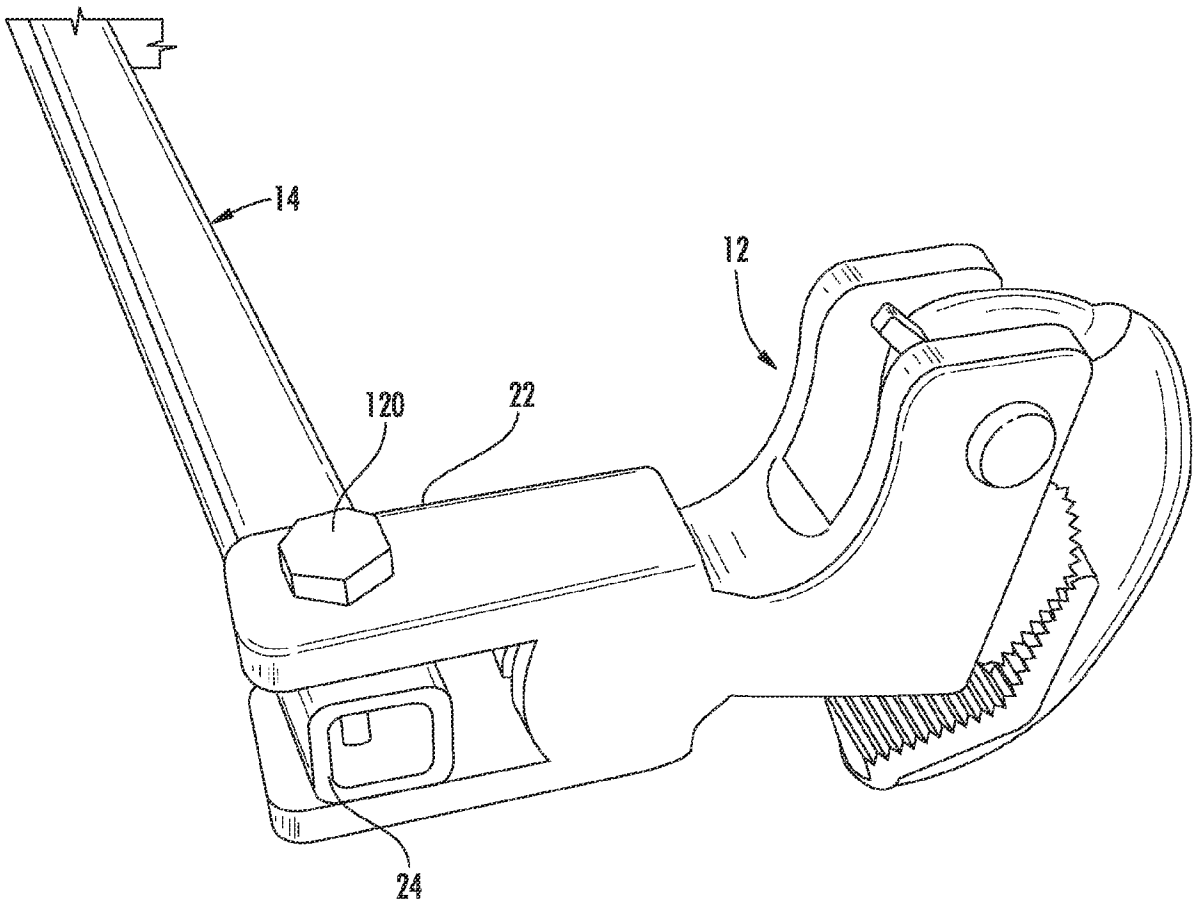
FIG. 12 shows a close-up perspective view of a hinge portion of an embodiment of a wrench toot as described herein.

The elongate arm member 14 preferably includes an elongate piece of square tubing. However, it is also understood that the arm member 14 may be formed of circular, ovular, or polygonal cross-sectionally shaped tubing. The arm member 14 includes a second hinge portion 24 located proximate a the distal end 15 of the arm member 14 adjacent the wrench head 12 for hingedly connecting the arm member 14 to the wrench member 12. With reference to FIG. 12, the first hinge portion 22 of the wrench member 12 is hingedly connected to the second hinge portion 24 of the arm member 14 using a fastener 120. In this embodiment, the fastener is in the form of a bolt, but other fasters and/or hinge designs known to a person having ordinary skill in the art are contemplated including, for example, universal joints and barrel hinges. In the embodiment shown in FIG. 12, the fastener 120 extends substantially through the first hinge portion 22 and the second hinge portion 24, thereby connecting the arm member 14 to the wrench member 12 and allowing the wrench member 12 to hinge with respect to the arm member 14.

With additional reference to FIG. 2, the wrench tool 10 further includes a handle member 16 including a distal end 25 and a proximal end 27 and is preferably formed of an elongate piece of polygonal tubing. However, it is also understood that the handle member 16 may be formed of circular, ovular, or other cross-sectionally shaped tubing. Referring to FIG. 2, the handle member 16 includes a sleeve portion 42 adjacent the distal end 25 of the handle member 16 for connecting the handle member 16 to the arm member 14. The sleeve portion 42 is formed such that the sleeve portion 42 fits along the arm member 14, preferably in a manner in which the sleeve portion 42 can be slid along the arm member 14 to different locations lengthwise along the arm member 14. In one embodiment, a first bore 26 extends through the sleeve portion 42 and a second bore 29 extends through the arm member 14. When the sleeve portion 42 is connected to the arm member 14, a pin 44 can be inserted through the first bore 26 and the second bore 29, thereby removably connecting the handle member 16 to the arm member 14.

Figure 4:
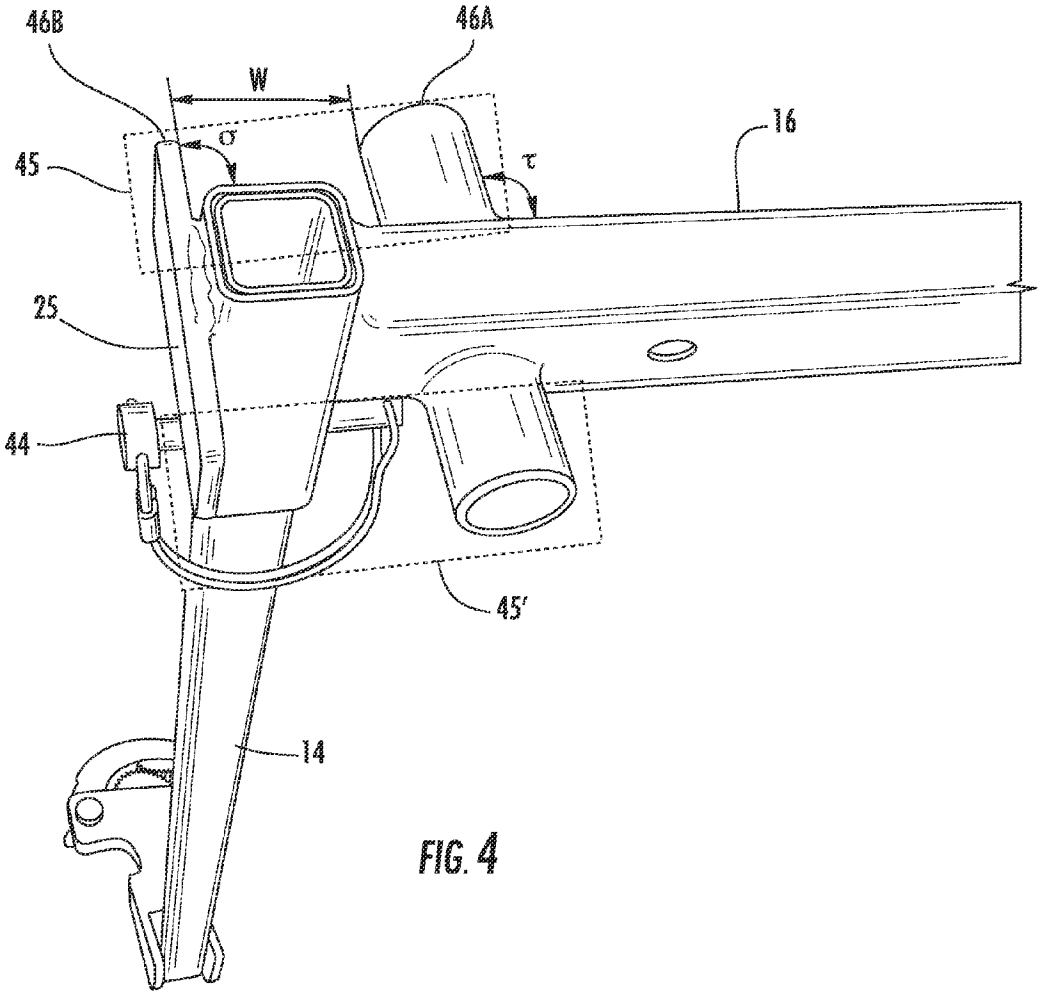
FIG. 4 shows a somewhat schematic close-up perspective view of the contact portion of an embodiment of a wrench tool described herein.

The handle member 16 further includes a contact portion 45 shown in FIG. 4. While the present discussion describes a first contact portion 45 located along one side of the handle member 16, it is also contemplated that a second contact portion 45 may be located on the opposite side of the handle member 16 and configured in the same manner as discussed herein. The contact portion 45 preferably includes a first appendage 46A and a second appendage 46B extending from the arm member 16 proximate the distal end 25 of the handle member 16 adjacent the arm member 14. The first appendage 46A preferably extends at an angle $\tau$ relative to the lengthwise orientation of the handle member 16, the angle preferably ranging from about 30° to about 150° and more preferably from about 80° to about 100°. In one embodiment, the second appendage 46B extends substantially parallel to the first appendage 46A. In an alternative embodiment, the second appendage 46B may extend at an angle $\sigma$ relative to the lengthwise orientation of the handle member 116, the angle $\sigma$ preferably ranging from about 30° to about 150° and more preferably from about 80° to about 100°. The first appendage 46A and the second appendage 46B form a gap W for receiving an elongate shaft of a separate tool.

Figure 3:
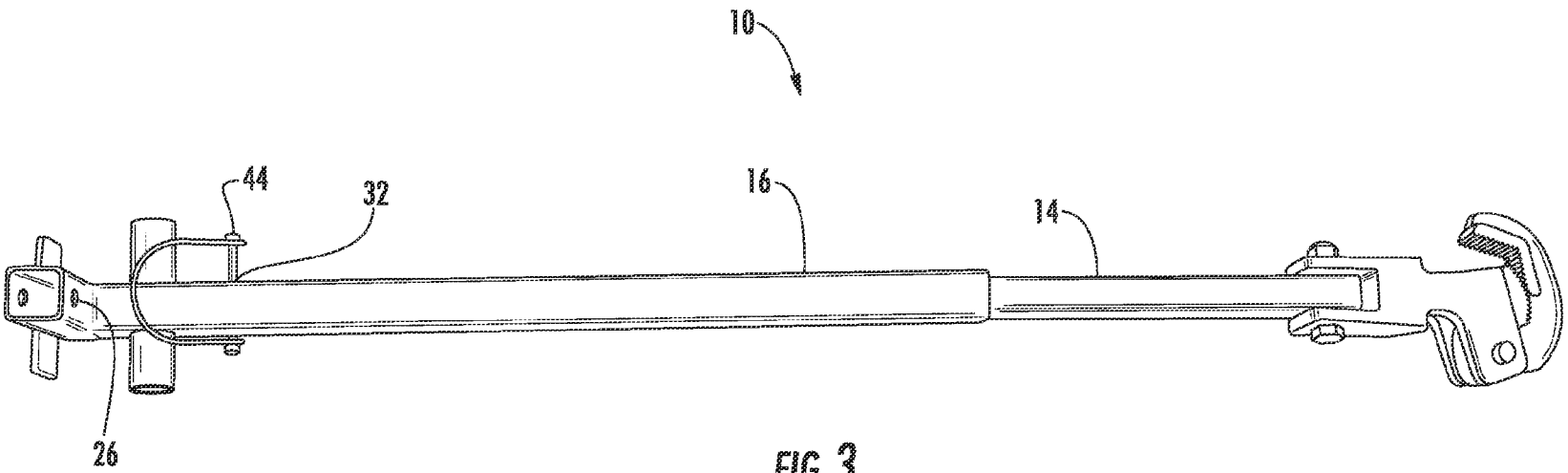
FIG. 3 shows a side view of the wrench tool of FIG. 1 in a second configuration.

FIG. 3 illustrates the wrench tool 10 configured for transportation, storage, or an alternate use. In the embodiment of FIG. 3, the cross-sectional width of the arm member 14 is less than the cross-sectional width of the hollow interior of the handle member 16 such that the arm member 14 may fit within and slidingly engage with the handle member 16. A third bore 32 (FIG. 2) extends cross-sectionally through the handle member 16 such that the removable pin 44 may be inserted through the third bore 32 and the second bore 29 to removably connect the arm member 14 to the handle member 16 in the configuration shown in FIG. 3. Alternatively, the width of the handle member 16 may be less than the width of the arm member 14 such that the handle member 16 may be secured within the arm member 14.

Figure 8:
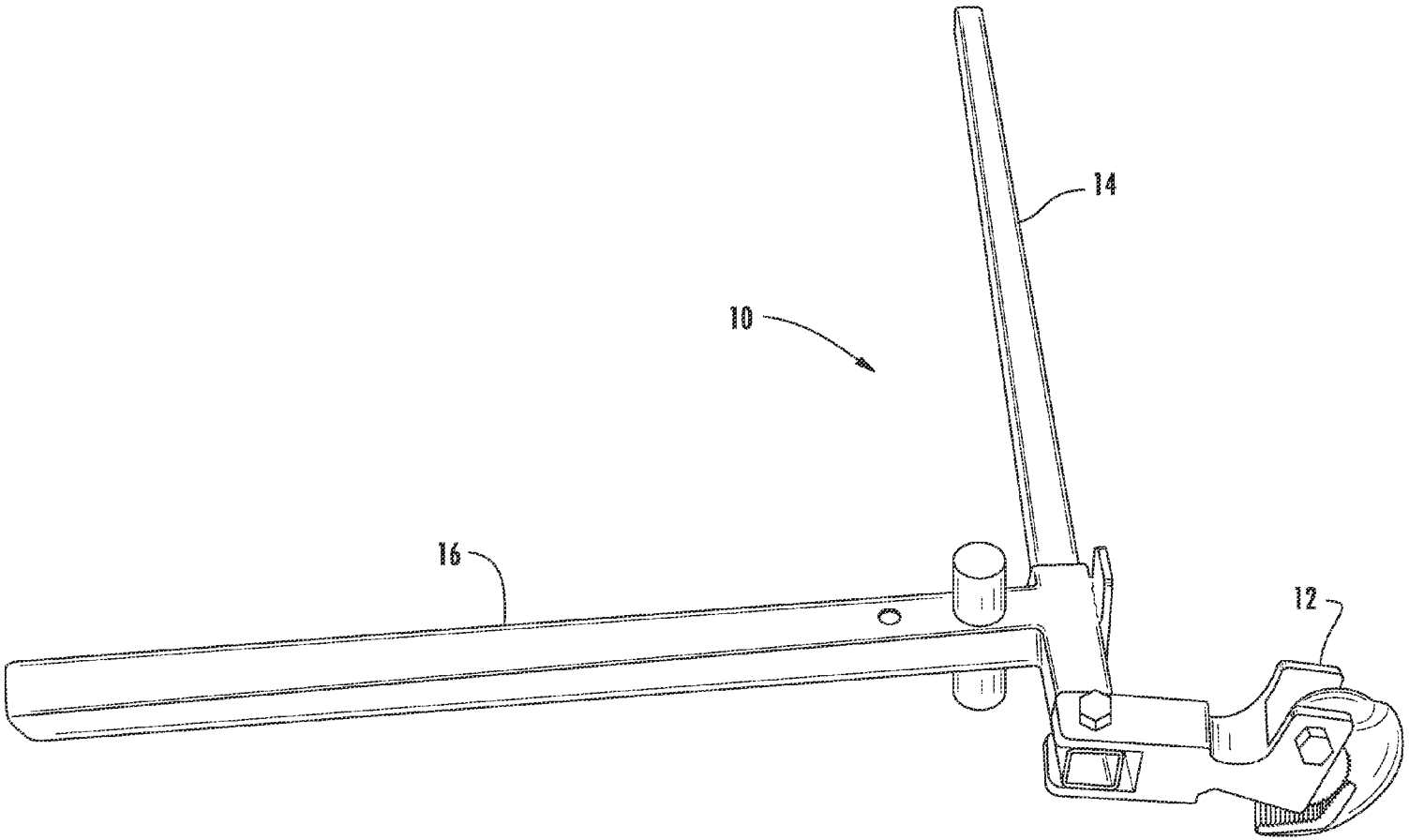
FIG. 8 shows a perspective view of the wrench tool of FIG. 1 shown in a third configuration.
Figure 9:
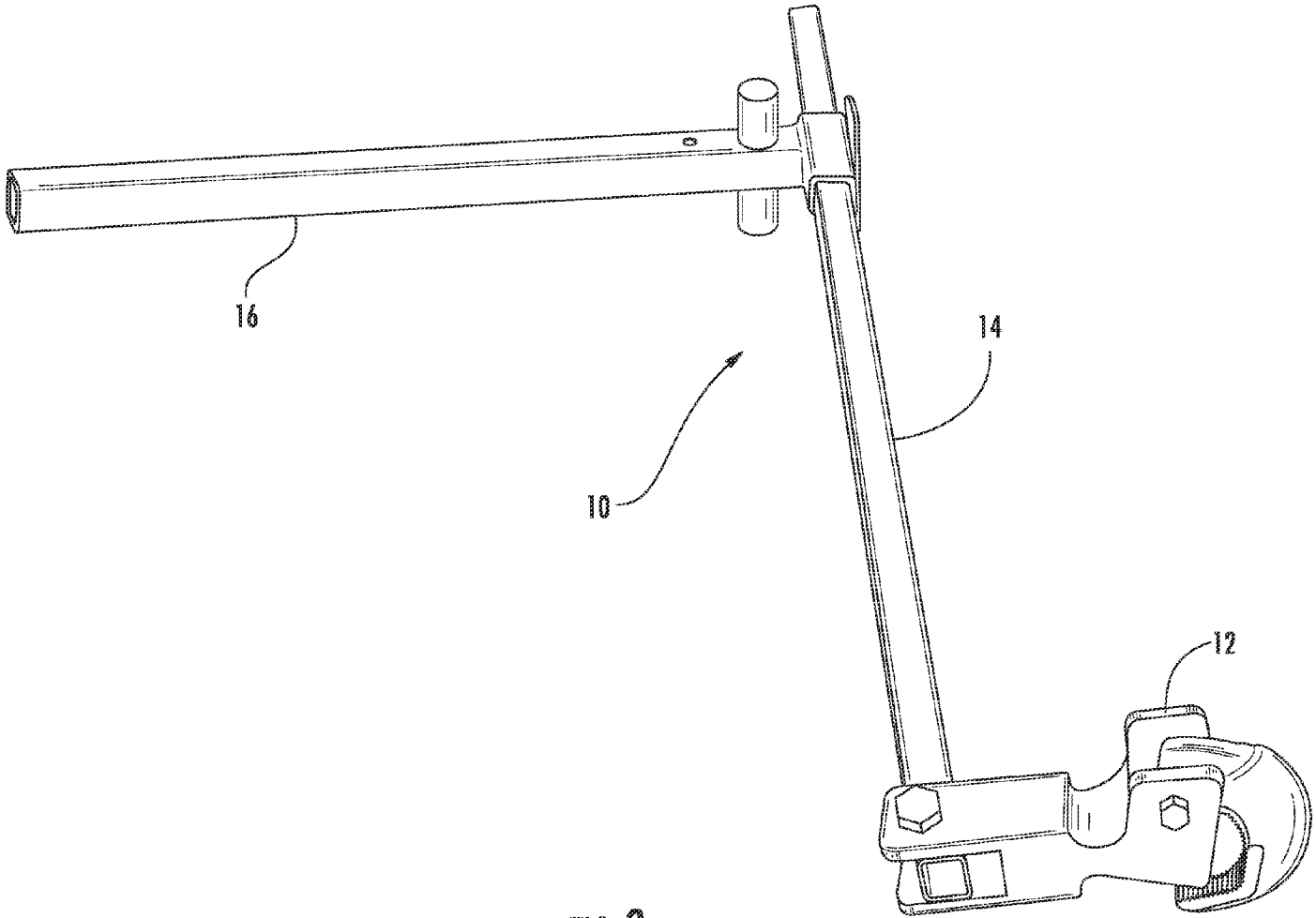
FIG. 9 shows a perspective view of another configuration of the wrench tool of FIG. 1.
Figure 10:
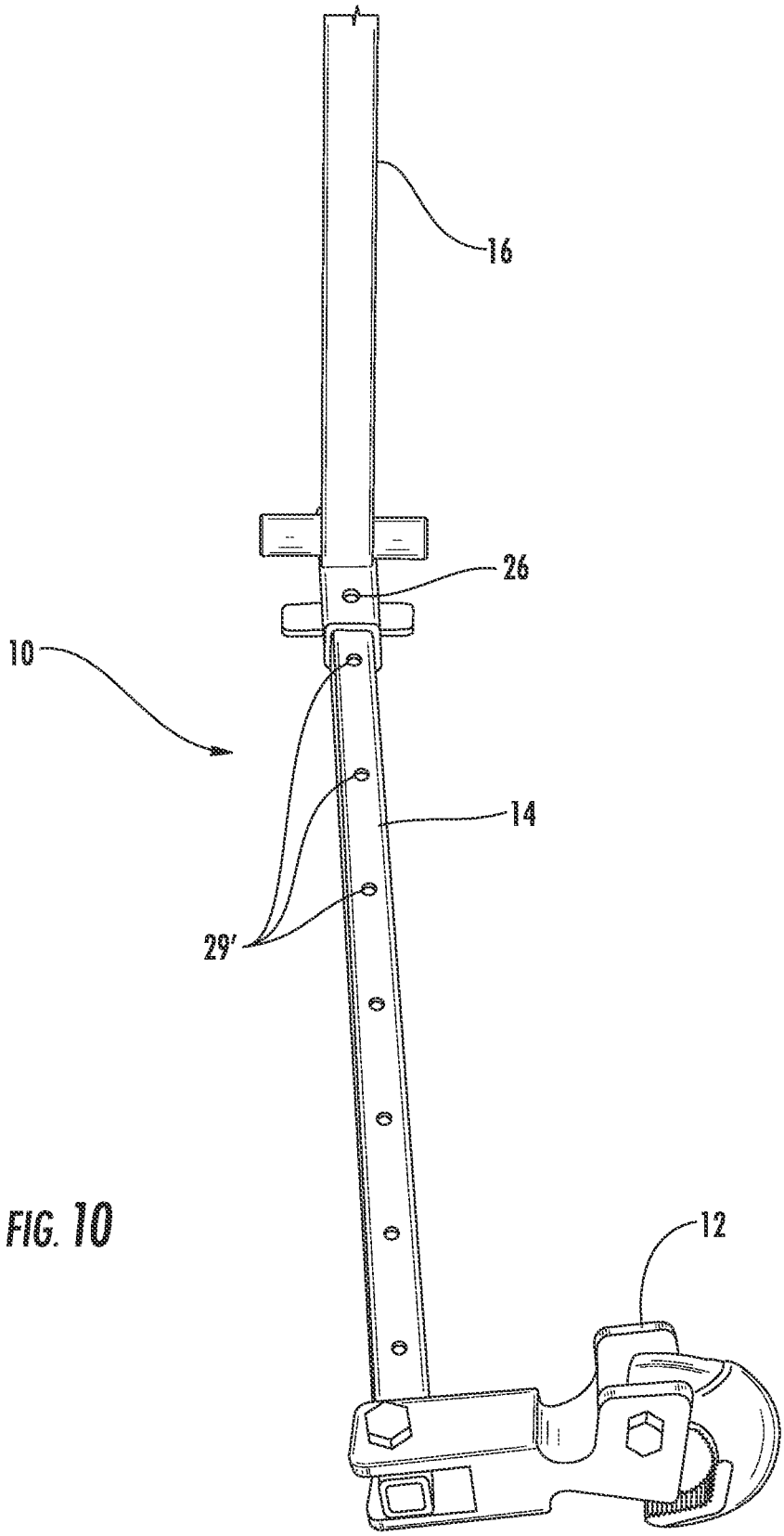
FIG. 10 shows a side view of yet another configuration of the wrench tool of FIG. 1.
Figure 11:
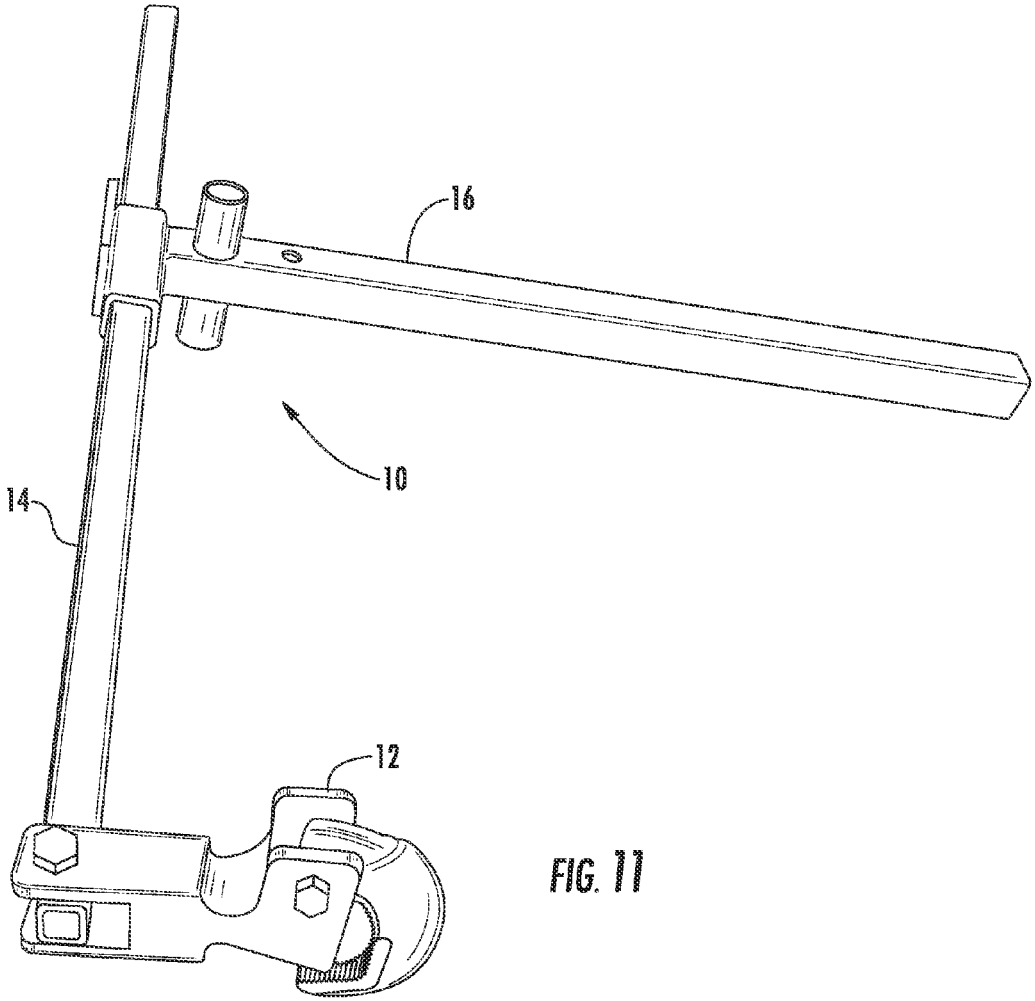
FIG. 11 shows a perspective view of yet another configuration of the wrench tool of FIG. 1.

FIGS. 8-11 illustrate various alternative configurations of the wrench tool 10. Optionally, the second portion of the handle member may further comprise a tube or sleeve portion 42 proximate the end of the handle member wherein the tube includes an elongate aperture therethrough wherein the cross-sectional shape, of the elongate aperture is substantially the same as the cross-sectional shape of the majority of the length of the elongate arm member, wherein the handle member can be connected to the arm member via a slidable connection wherein the tube is slidable along the majority of the length of the arm member. For example, FIG. 8 shows the handle member 16 connected to the arm member 14 adjacent the wrench head 12. FIG. 9 shows the handle member 16 connected to the proximal end 17 of the arm member 14, FIGS. 10 and 11 show various positions of the handle member 16 in relation to the wrench member 12. FIG. 10 further shows a plurality of alternate bores 29' where the handle member 16 can be secured to the arm member 14 at different locations along the arm member 14.

In one embodiment of the present disclosure, the handle member 16 further includes a grip portion 28 (FIG. 2) disposed around the proximal end 27 of the handle member 16.

Figure 5:
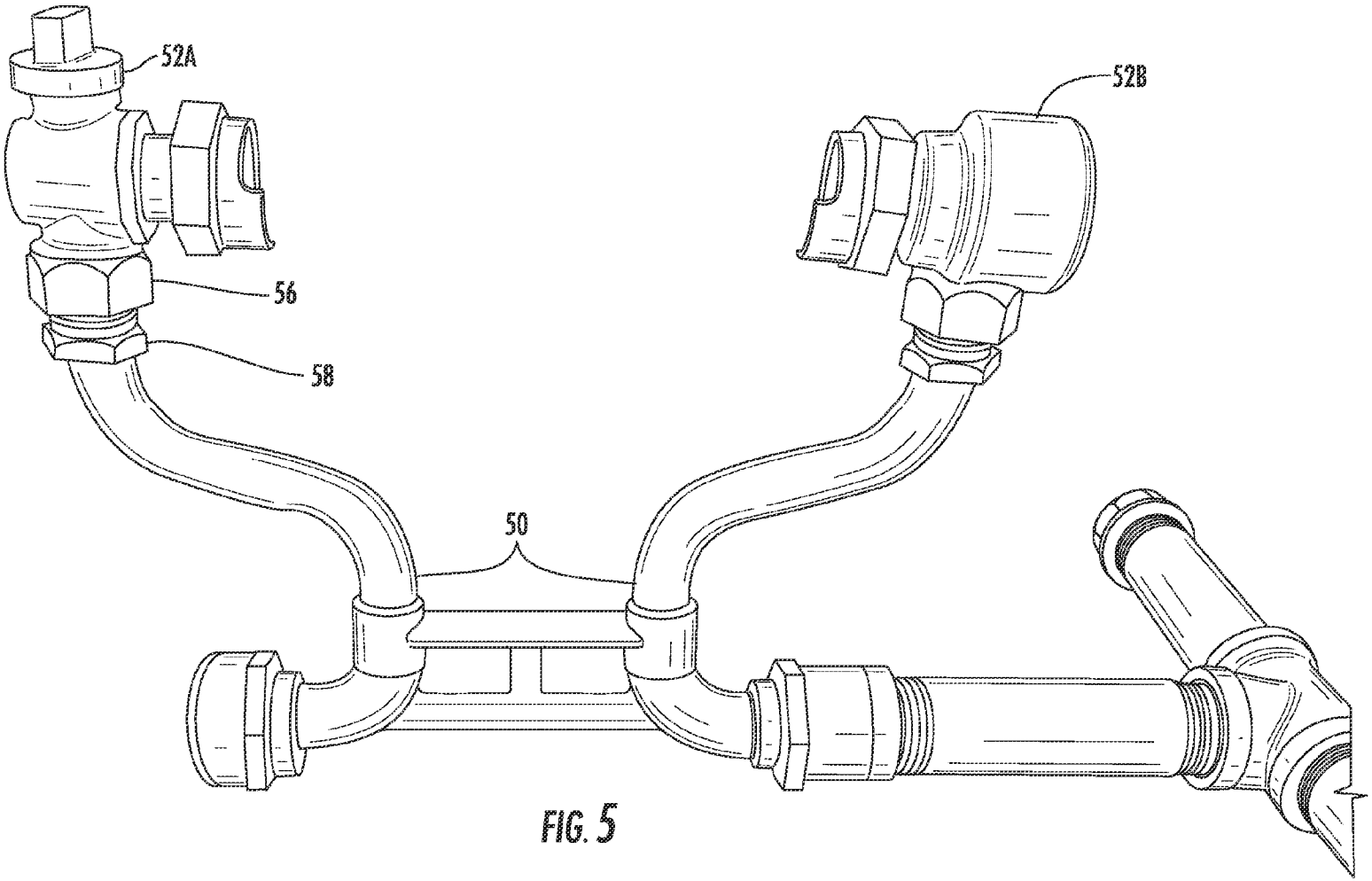
FIG. 5 shows a side view of a fluid meter yoke as described herein.

FIG. 5 illustrates a common water meter yoke assembly 50 including an angle valve 52A and a check valve 52B. The water meter typically installed in the water meter yoke assembly 50 has been omitted from this figure for the purpose of more clearly illustrating, for example, the installation and removal of valves 52A and 52B. Examples of common valves used on a water meter yoke assembly include both check valves and angle valves. The valves 52A and 52B include a valve attachment section 56 that is engaged with a yoke attachment section 58. To remove or install the valves 52A and 52B, the yoke attachment section 58 must be substantially secured in place while manipulating the valve attachment section 56 or valve 52A. Securing the yoke attachment section 58 allows the valve attachment section 56 to be rotated in relation to the yoke attachment section 58.

Figure 6:
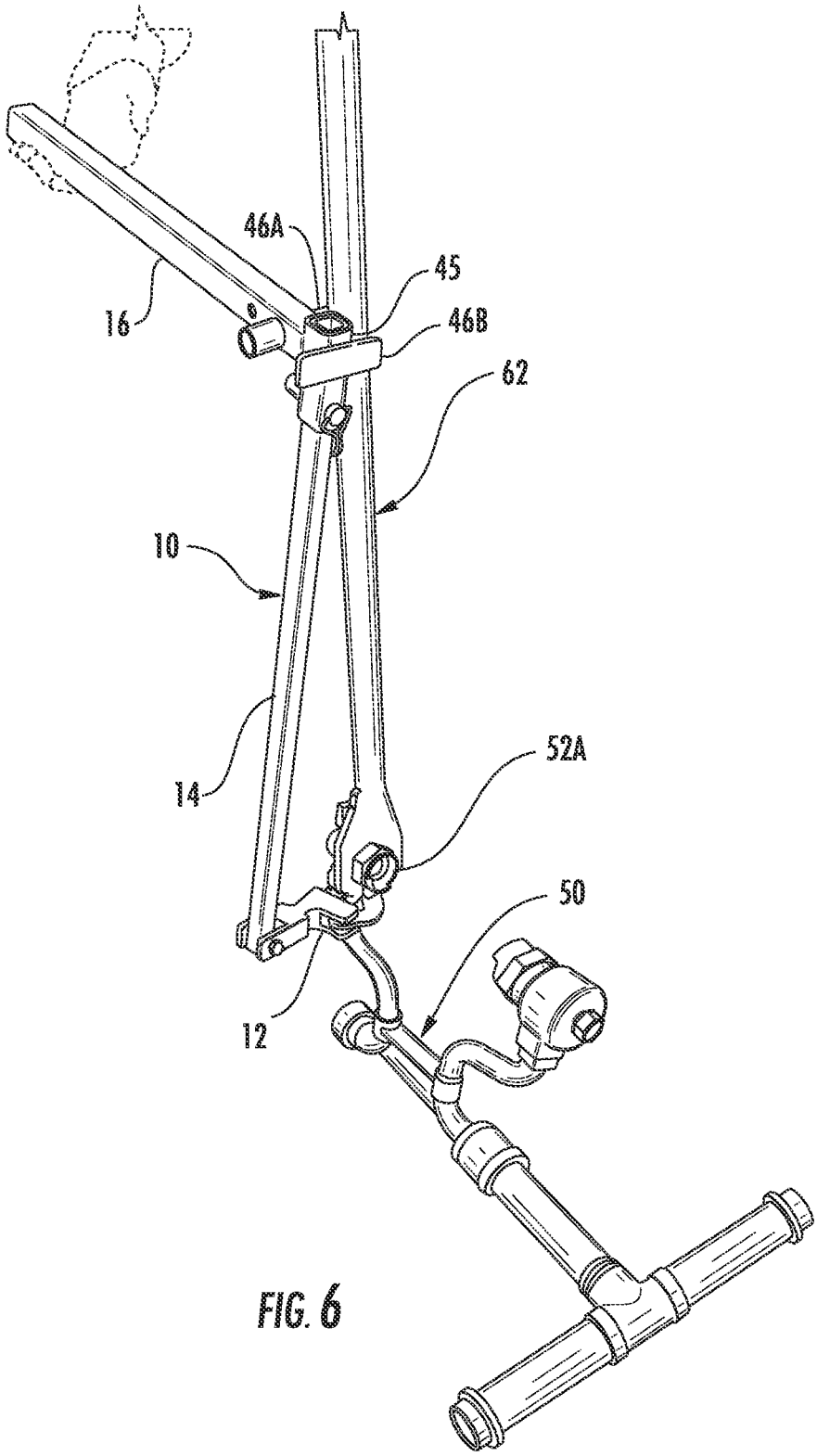
FIG. 6 shows a somewhat schematic perspective view of an embodiment of a wrench tool manipulating a fluid meter valve as described herein.
Figure 7:
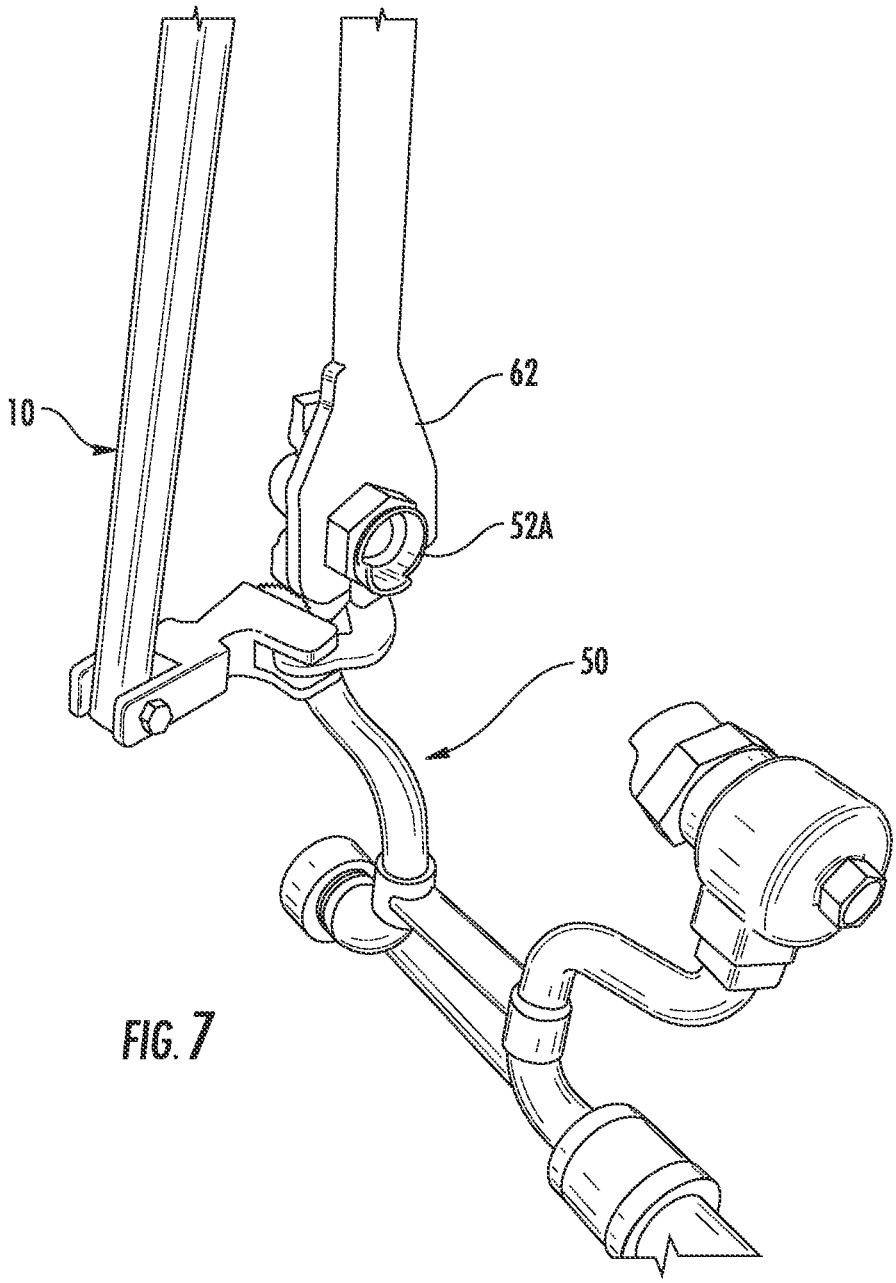
FIG. 7 shows a close-up perspective view of an embodiment of a wrench tool manipulating a fluid meter valve as described herein.

With reference to FIG. 6, a method of using an embodiment of the present wrench tool 10 to manipulate a valve 52A on a water meter yoke assembly 50 is shown. To manipulate the valve 52A, the wrench tool 10 of the present disclosure and a valve wrench 62 may be used concurrently by a single person. FIG. 7 shows a close-up view of the wrench tool 10 and the valve wrench 62 engaging the valve 52A of the water meter assembly 50. In one embodiment, the wrench member 12 of the wrench tool 10 engages the yoke attachment section 58 of the valve 52A. The first hinge portion 22 and the second hinge portion 24 of the wrench tool 10 allow the arm member 14 to extend substantially orthogonally to the wrench member 12 such that the arm member 14 may extend in an upward direction from the water meter yoke assembly 50 toward a user. The valve wrench 62 then engages the valve 52A. The valve wrench 62 engages the first contact portion 45 such that the valve wrench 62 fits between the first appendage 46A and the second 46B.

To remove the valve 52A from the water meter yoke assembly 50, the valve wrench 62 may be rotated counter-clockwise along its lengthwise axis relative to the yoke attachment section 58 held in place by the wrench tool 10. To install the valve 52A, the process may be reversed such that the wrench tool 10 secures the yoke attachment section 58 in place while the valve wrench 62 rotates the valve 52A in a clockwise direction relative to the yoke attachment section 58. In an alternative embodiment, the wrench tool 10 may rotate the valve 52A relative to the yoke attachment section 58.

When the valve wrench 62 applies a torque to the valve 52A, the torque is also applied to the yoke attachment section 58 and the wrench tool 10 engaged with the yoke attachment section 58. The torque transfers through the wrench member 12, arm member 14, and to the handle member 16. The handle member 16 is placed directly adjacent the user such that the user holds the wrench in place in some manner (e.g., by holding the handle member 16 against the user's leg) and thereby resists the torque created by the valve wrench 62 turning the valve 52A and thereby allowing the valve 52A to rotate with respect to the yoke attachment section 58 held in place by the wrench tool 10.

The wrench member 12, the arm member 14 and the handle member 16 may be formed of iron, aluminum, copper, titanium and other similar metals as well as alloys made of these and other metals, such alloys including, for example, various grades of steel.

The previously described embodiments of the present disclosure have many advantages, including the advantage of enabling a single user to perform the above-described method of removing a valve 52A from a water meter yoke assembly 50. Other methods of removing the valve 52A from the water meter yoke assembly 50 require a second user to engage the yoke attachment section 58 with a wrench to hold the yoke attachment section 58 in place while a first user manipulates the valve 52A with a valve wrench 62. One embodiment of the present wrench tool 10 allows a user to position the handle member 16 directly adjacent the user's body to prevent rotation of the yoke attachment section 58 while the user installs or removes the valve 52A of the water meter yoke assembly 50. Alternative embodiments of the wrench tool 10 allow the tool to be used in various configurations to allow the tool to engage a valve or other component of a water meter yoke assembly in difficult to reach locations. Further, the wrench tool 10 may be configured for use as a traditional pipe wrench.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A tool for manipulating a piece of plumbing hardware configured for connection to a fluid meter yoke, the tool comprising:

a wrench member including a wrench head and an attachment portion, the attachment portion including a first hinge portion;

an elongate arm member including a proximal end and a distal end, wherein a second hinge portion is located adjacent the distal end of the arm member and is engageable with the first hinge portion to form a hinge such that the first arm member is configured to optionally extend substantially orthogonal to the wrench member;

an elongate handle member including a proximal end and a distal end, wherein the distal end of the handle member is removably connected to the proximal end of the first elongate arm member, the handle member configured to extend at an angle $\alpha$ relative to the arm member;

a securing structure to secure the connection between the arm member and the handle member;

a first appendage adjacent the distal end of the handle member extending at an angle $\tau$ relative to the lengthwise orientation of the handle member;

a second appendage proximate the first appendage, the second appendage extending at an angle $\sigma$ relative to the lengthwise orientation of the handle member, forming a gap between the first appendage and the second appendage for partially contacting an elongate shaft of a separate object wherein the separate object is free to rotate along its length axis while the tool optionally remains unmoved;

a first length portion of the arm member starting from the proximal end of the arm member and a first length portion of the handle member starting at the proximal end of the handle member wherein the first length portion of the arm member is slidably engageable along the first length portion of the handle member; and a second length portion of the handle member starting at the distal end of the handle member and extending orthogonal to the first length portion of the handle member, wherein the first length portion of the arm member is slidably engageable with the second length portion of the handle member.

2. The tool of 1 wherein the second length portion of the handle member includes a first bore therethrough crosswise and the first length portion of the arm member includes a second bore therethrough crosswise, wherein the first bore and the second bore are substantially aligned wherein the removable pin can be extended therethrough to hold the arm member in place relative to the handle member.

3. The tool of claim 1 wherein the first length portion of the arm member further comprises a plurality of alternate bores therethrough crosswise wherein the first bore and each member of the plurality of alternate bores can be substantially aligned wherein a removable pin can be inserted therethrough to hold the arm member in place relative to the handle member.

4. The wrench tool of claim 3 wherein the distal end of the handle member is removably connected to the proximal end of the elongate arm member.

5. The tool of claim 2 wherein the second length portion of the handle member further comprises a tube proximate the distal end of the handle member wherein the tube includes an elongate aperture therethrough wherein the cross-sectional shape of the elongate aperture is substantially the same as the cross-sectional shape of the majority of the length of the elongate arm member, wherein the handle member can be connected to the arm member via a slidable connection wherein the tube is slidable along the majority of the length of the arm member.

* * * * *